United States Patent [19]

Scott

[11] 3,986,552

[45] Oct. 19, 1976

[54] PUMPING SYSTEM FOR HIGH VISCOSITY OIL

[75] Inventor: John Coy Scott, Houston, Tex.

[73] Assignee: Thick Oil Extractor Service, Inc., Houston, Tex.

[22] Filed: Feb. 3, 1975

[21] Appl. No.: 546,275

[52] U.S. Cl. ..... 166/106; 166/314

[51] Int. Cl.[2] ..... E21B 43/00

[58] Field of Search ..... 166/314, 105, 106; 417/260, 431

[56] References Cited

UNITED STATES PATENTS

| | | | |
|---|---|---|---|
| 1,771,070 | 7/1930 | Bannon | 417/431 |
| 2,215,558 | 9/1940 | Miller | 166/105 |
| 2,530,673 | 11/1950 | Zinszer | 166/105 X |
| 2,684,639 | 7/1954 | Sutton | 417/260 |
| 3,209,830 | 10/1965 | Orr et al. | 166/84 |

*Primary Examiner*—Stephen J. Novosad

[57] ABSTRACT

This disclosure pertains to pumping of heavy petroleum products such as crude oil from 8API gravity and greater. A tubing is packed off by a production packer in a well casing and a piston is reciprocated in the tubing below the packer by a pumping rod to pump oil upwardly in the tubing. Above the packer is a standing valve which places the interior of the tubing into fluid communication with the annulus between the casing and the tubing on an upstroke of the piston and closes the communication path on a downstroke of the piston. Above the standing valve is a packing means through which the pumping rod extends, the packing means isolating the interior of the tubing above the packing means from the standing valve below the packing means. The tubing above the packing means is filled with a light weight fluid. Reciprocation of the rod is principally through the lighter weight fluid and the weight of the lifted oil in the annulus is isolated by the standing valve from the tubing below the packing means.

3 Claims, 2 Drawing Figures

PUMPING SYSTEM FOR HIGH VISCOSITY OIL

FIELD OF THE INVENTION

This invention relates to a system for pumping heavy viscous crude oil, and more particularly, to a system for increasing the efficiency of a reciprocating pumping system to produce heavy crude oil from an oil well.

In the prior art systems, which are many, various uses have been made of standing valves (one-way flow valves) to control the back flow of fluids being pumped from a well. Similarly, pumping rod systems are well known. Nonetheless, the problem of pumping heavy, viscous crude oil remains difficult to solve. Both mechanical and chemical proposals have been used heretofore, however, the present system employs an arrangement which minimizes the effect of viscosity on the downstroke of a standing rod string as well as on the upstroke. The hydrostatic effect of the oil is also minimized by isolating a substantial volume of the pumped fluid from the pumping piston.

Generally considered, a downhole pump which is reciprocated by a sucker rod string includes a downhole piston and a one-way flow valve arrangement. On a downstroke, the flow valve is opened permitting the piston to move downwardly and on an upstroke the flow valve is closed so that the fluid above the piston is lifted in the tubing. As the fluid column above the piston is lifted through the tubing, the fluid is discharged at the surface. When heavy viscous crude oil is pumped, there is a viscous drag on the sucker rod string which slows down its free fall by gravity on the downstroke. On the upstroke, this drag also slows down the speed of the pump plunger because of stretch in the rods, and decreases the oil flow through the tubing, and increases the power required to raise the oil and string of rods. Where the oil is highly viscous, the depth of operation of the pump is limited.

SUMMARY OF THE INVENTION

Briefly, the invention involves a system for producing heavy viscous oil from a production well using a downhole reciprocating pump. The production tubing has a production packer set in the well casing above the production zone. A downhole pumping unit on the tubing includes a pumping barrel, a reciprocating piston and a one-way flow valve system. This piston is coupled to a sucker rod string and reciprocated by a surface pumping unit. On the downstroke of the pump, the flow valve system is open permitting the piston to pass through the fluid in the tubing. On the upstroke of the pump, the flow valve system is closed permitting the piston to lift the fluid above the piston in the tubing. Above the production packer is a one-way flow valve which communicates the interior of the tubing to the annulus between the tubing and the well casing and prevents fluid flow in a reverse direction from the annulus to the tubing string. Above the one-way flow valve in the tubing is a packing means which sealingly and slidably engages the sucker rod string and is sealed with respect to the tubing. Thus, the production oil must flow from the piston pump through the tubing flow valve into the annulus between the casing and tubing. (Reverse flow is prevented by the tubing flow valve.) The annulus between the tubing and sucker rod string is filled with a light weight relatively non-viscous fluid. With this system the method consists of pumping heavy viscous oil from a production zone to the annulus between the tubing and casing, preventing a back flow of viscous oil to the production zone, and maintaining the stroking mechanism in the tubing in a light weight relatively non-viscous fluid.

Other features and advantages of the present invention will appear from the following description when taken in connection with the drawings.

DESCRIPTION OF THE PREFERRED EMBODIMENT

Figure 1:
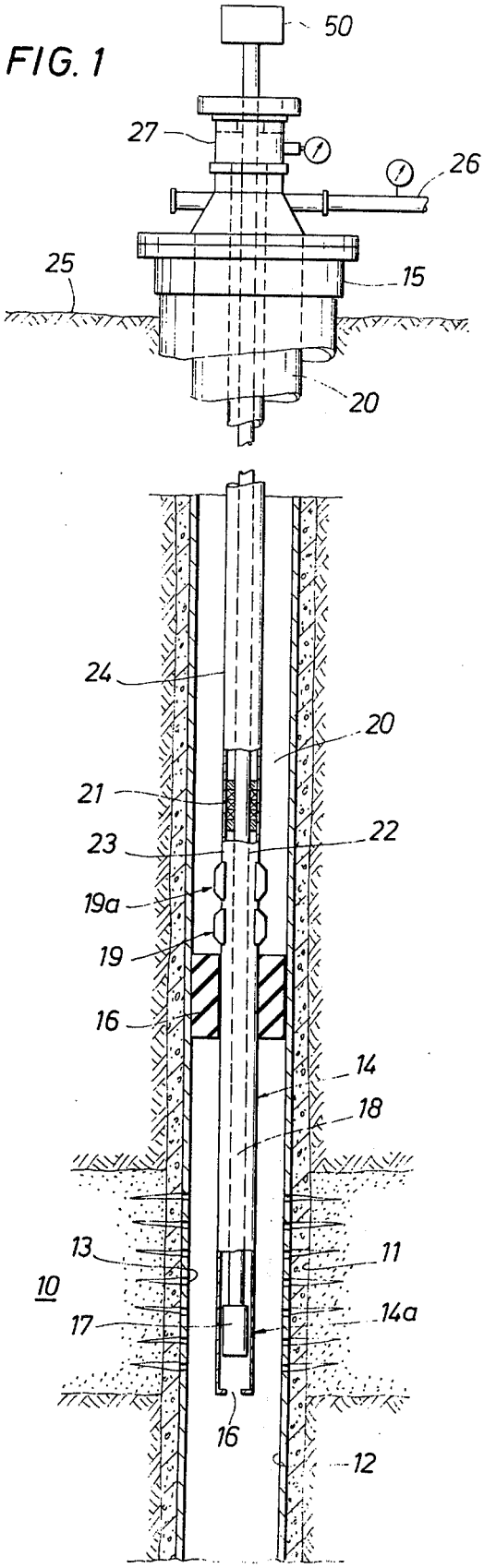
FIG. 1 is a schematic representation of a production system embodying the present invention.

Referring now to the drawings, in FIG. 1, the earth formations 10 are traversed by a well bore 11. A casing 12 is disposed in the well bore 11 and cemented in place in a conventional manner. The casing 12 has perforations 13 which extend through the casing, the cementing, and into the formations so that oil may be produced therefrom.

A production tubing 14 extends from a surface well head 15 and has an open end **16*a* through which oil from the earth formations can enter into the tubing. The tubing 14 is attached to a conventional production packer 16 which closes off the cross section of the casing and the annulus between the casing and the tubing. The production packer also anchors the tubing in the well. Below the production packer 16, the tubing has a section 14*a* with a polished interior surface in which a reciprocating piston 17 is slidably received. The piston 17 includes a conventional one-way valve (not shown) which opens upon downward movement of the piston to bypass fluid and closes upon upward movement of the piston to lift fluid. The piston 17 is connected to a sucker rod string 18** which extends to the surface and is attached there to a conventional puming unit (not shown).

Above the packer 16 in the tubing string 14 are tubing flow valve means 19 and **19*a* which communicate the interior of the tubing string 14 at that point to the annulus 20 formed between the tubing and the well casing 12. The flow valve means 19 and 19*a* are one-way valve means in that they prevent return of fluid from the annulus 20** to the interior of the tubing.

In the tubing string 14 just above the tubing flow valve means **19*a* is a packing means 21. This packing means may be a sub in which annular sealing or packing elements are compressed between brass annular end elements to sealingly engage the interior wall of the sub and slidably and sealingly engage the section 22 of the sucker rod string. The section 22 of the sucker rod string is polished for ease of sliding movement and sealing in the pack-off means or packing means 21. The purpose of the pack-off means 21 is to isolate the annulus 23 between the sucker rod 18 and tubing 14 below the pack-off means 21 from the annulus 24 between the rod 18 and tubing above the pack-off means 21. In the practice of the present invention, the annulus 24 above the pack-off means 21** is filled with a lighter and relatively non-viscous fluid such as distillate or kerosene.

At the earth's surface 25 the well head 15 connects the annulus 20 to an output flow line 26. A lubricator 27 is provided through which the rod 18 can be reciprocated and lubricated at the same time in a well known manner.

Figure 2:
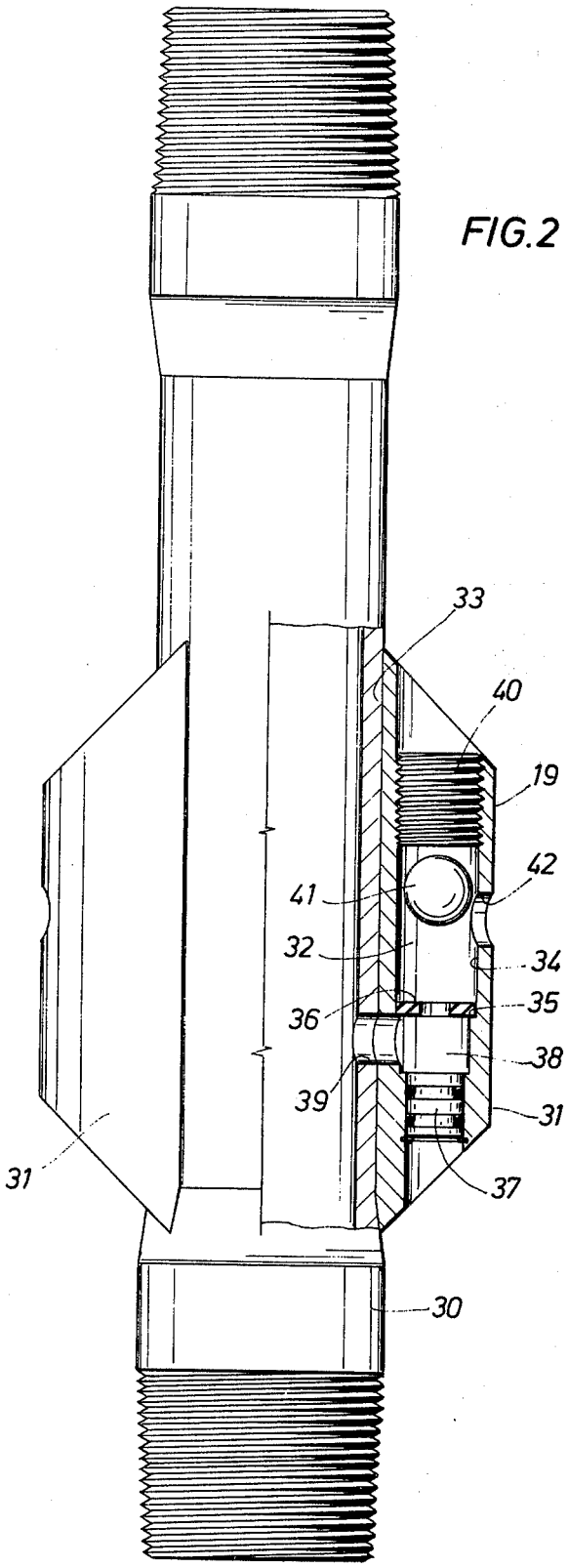
FIG. 2 is an enlarged view of a tubing flow valve arrangement for use in the present system.

Referring now to FIG. 2, the flow valve 19 includes a tubular sub 30 which is connectable in the tubing string as a part thereof. On the surface of the sub 30 are radially spaced valve elements 31 which can vary in number as necessary or desired. A valve element 31 is elongated and has a curved inner surface 33 fitted to the curvature of the sub 30. A longitudinally extending bore 34 in the element 31 has a stepped portion 35 midway of its length. An annular valve seat 36 is mounted on the stepped portion 35. The bore portion 38 below the valve seat 36 is sealed with a plug 37. Between the plug 37 and seat 36, the bore portion 38 is connected by transverse ports 39 to the interior bore of the sub 30. The bore portion 38 above the seat 36 is closed with an end cap 40 and contains a sealing ball 41 which is adapted to sealingly engage with the seat 36. The bore portion 38 is also connected by a side port 42 to the exterior of the sub 30. It will be appreciated that flow of fluid from the bore of sub 30 into the ports 39 will displace the ball 41 from the seat 36. When the pressure is released, the ball 41 will close the opening on the seat 36 so that a reverse flow is prevented.

In the operation of the system of the present invention, tubing 14 and packing-off means 16 are disposed in the well bore 11 so that the packer is located above the producing perforations 13. The pump 17 is reciprocated by a surface means 50 so that oil is induced to flow into the tubing. The oil is heavy and viscous in the range of 8 to 15 API gravity. On the upstroke of the piston 17, the oil is lifted and on the downstroke, the oil bypasses the piston 17. Just above the packer 16 is a flow valve means 19 which passes fluid from the interior of the tubing to the annulus 20 between the casing and the tubing. The flow valve 19 has a ball 41 which seats or unseats on seat 36 as a function of pressure of the oil. When oil is lifted by the piston and passes into the annulus, it cannot reverse through the valve 19 and the hydrostatic pressure of the oil in the annulus is isolated from the pumping means. Above the valve means 19 is a packing means 21 which seals off the annulus between the sucker rod and the tubing. This permits the tubing volume above the packing means 21 to be filled with a light, low viscosity fluid and thereby reduce the viscosity drag on the sucker rod. At the earth's surface, the lubricator 27 closes off the upper end of the tubing.

While particular embodiments of the present invention have been shown and described, it is apparent that changes and modifications may be made without departing from this invention in its broader aspects; and therefore, the aim in the appended claims is to cover all such changes and modifications as fall within the true spirit and scope of this invention.

What is claimed is:

1. A system for pumping heavy viscous oil from earth formations comprising:

a tubing string adapted to be packed off in a well bore above a producing formation, packing-off means for packing off the cross section of said tubing string with respect to the well bore at the location in a well above a producing formation, reciprocating pump means in said tubing string, sucker rod means for reciprocating said pump means in said tubing strings, said pump means being constructed and arranged to lift fluid on an upstroke and bypass fluid on a downstroke of said sucker rod means, flow valve means in said tubing string above said packing-off means constructed and arranged for passing fluid from the interior of the tubing string to the annulus between the tubing string and the well bore and for preventing return of fluid from the annulus to the tubing string, and packing means disposed in said tubing above said flow valve means, said packing means being constructed and arranged to slidably and sealingly engage the sucker rod string and close off the cross section of the tubing string at a location just above the flow valve means so that the tubing string above said packing means can be filled with any desired fluid.

2. The apparatus as defined in claim 1 and further including a surface located lubricator means connected to the tubing string and wherein said desired fluid has a relatively low viscosity to reduce the drag on the sucker rod means.

3. The apparatus as defined in claim 2 and further including in said flow valve means one-way valve means comprising a movable ball in a bore and a valve seat whereby fluid pressure seats and unseats the ball relative to the valve seat.

* * * * *